US006430755B1

(12) United States Patent
Smith

(10) Patent No.: US 6,430,755 B1
(45) Date of Patent: Aug. 13, 2002

(54) DISPOSABLE BODILY WASTE COLLECTOR

(76) Inventor: Dorothy J. Smith, 3629 W. Congress, Milwaukee, WI (US) 53209

( * ) Notice: Subject to any disclaimer, the term of this patent is extended or adjusted under 35 U.S.C. 154(b) by 0 days.

(21) Appl. No.: 09/592,807

(22) Filed: Jun. 13, 2000

Related U.S. Application Data

(63) Continuation of application No. 09/249,894, filed on Feb. 16, 1999, now abandoned.

(51) Int. Cl.[7] ..... A47K 11/12

(52) U.S. Cl. ..... 4/144.2; 4/144.1; 604/349; 604/385.19

(58) Field of Search ..... 4/144.1, 144.2; 604/349, 385.19

(56) References Cited

U.S. PATENT DOCUMENTS

| | | | | |
|---|---|---|---|---|
| 2,819,472 A | | 1/1958 | Sullivan | 4/144.2 |
| 3,889,869 A | | 6/1975 | Oggesen | 383/4 X |
| 4,360,932 A | | 11/1982 | Yoshida | 4/144.2 |
| 4,453,938 A | | 6/1984 | Brendling | 604/349 X |
| 4,627,846 A | * | 12/1986 | Ternstrom | 604/349 |
| 4,804,377 A | | 2/1989 | Hanifl et al. | 604/352 |
| 5,007,116 A | | 4/1991 | Yamamoto | 4/144.2 |
| 5,065,459 A | | 11/1991 | Tjahaja et al. | 4/144.2 |
| 5,235,705 A | | 8/1993 | Belisle | 4/144.3 |
| 5,318,549 A | | 6/1994 | Yang | 4/144.1 X |
| 5,329,644 A | | 7/1994 | Scott | 4/144.2 |
| 5,409,474 A | * | 4/1995 | Fleeman-Hardwick | 604/349 |
| 5,609,901 A | | 3/1997 | Geddes et al. | 383/4 X |

* cited by examiner

*Primary Examiner*—Robert M. Fetsuga
(74) *Attorney, Agent, or Firm*—Quarles & Brady LLP

(57) ABSTRACT

A portable, disposable collector for human bodily wastes is formed as a pouch of plastic film material with an open top. An absorbant layer is disposed inside the pouch. Opposite sides of the pouch have tear lines that extend from the opening toward the bottom of the pouch to convert the collector from male to female use and to collect feces. An adhesive patch on the outside of the pouch is used to seal a used, folded collector.

4 Claims, 1 Drawing Sheet

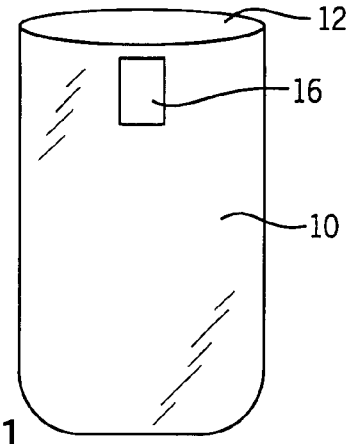
FIG. 1
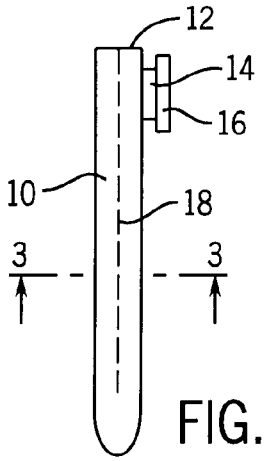
FIG. 2
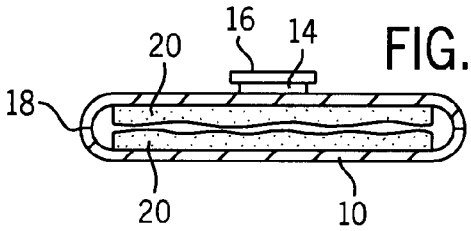
FIG. 3
FIG. 4
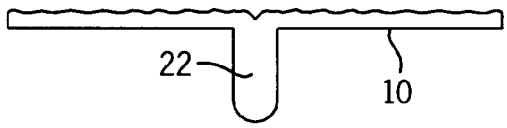
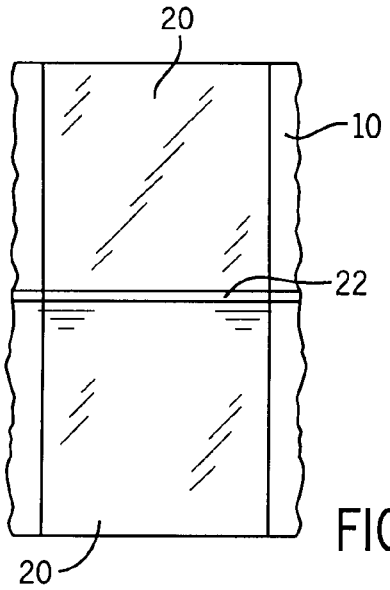
FIG. 5
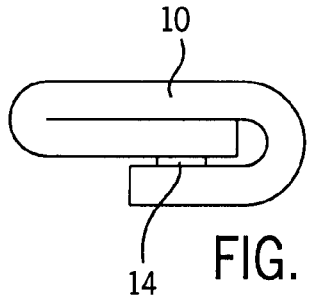
FIG. 6

DISPOSABLE BODILY WASTE COLLECTOR

RELATED APPLICATION

This application is a continuation of Application No. 09/249,894, filed Feb. 16, 1999 abandoned.

BACKGROUND OF THE INVENTION

This invention relates to a disposable collector for bodily wastes, and particularly to a portable collector that is adapted for use by both males and females and which collects both urine and feces.

Portable urine collectors are known. They are typically designed for use by either an adult male (U.S. Pat. Nos. 4,360,932; 5,065,459 and 5,235,705) or by an adult female (U.S. Pat. No. 5,329,644). Those urine collectors that have been designed for use by both genders are generally large and bulky and do not lend themselves to be carried on the person who may have need for its use. See for example U.S. Pat. No. 5,007,116.

A collector according to my invention can be used by either gender to collect urine or feces. It is compact and easily carried on the person of the user. It is readily disposable.

SUMMARY OF THE INVENTION

According to the invention, a portable bodily waste collector is formed of a flexible, liquid impervious pouch having an opening at one end. An absorbent layer is dispose in the pouch. Tear lines are provided in opposite sides of the pouch leading from the opening. In its normal configuration, the opening in the pouch accommodates the male genitalia. By tearing the sides of the pouch along the tear lines, the opening is enlarged to accommodate the female genitalia or to collect feces from either gender.

The collector may be provided with an adhesive patch on its exterior adjacent the opening. Following use, the pouch can be folded to close the opening and can be secured by engagement of the adhesive patch with an opposing surface of the folded pouch. Alternate means for closing and sealing the pouch include hook and loop fasteners.

Preferably, the pouch is formed in one piece from a film of a plastic resin material and the absorbent layer is formed from a batt of cellulose or similar material such as used in disposable diapers.

The foregoing and other objects and advantages of the invention will appear from the detailed description that follows. In the description, reference is made to the accompanying drawing which illustrates a preferred embodiment of the invention.

BRIEF DESCRIPTION OF THE DRAWINGS

FIG. 1 is a front view of the collector;

FIG. 2 is a side view of the collector;

FIG. 3 is a view in cross section taken in the plane of the line 3—3 of FIG. 2;

FIG. 4 is a side view showing the collector opened for use by a female or to collect feces;

FIG. 5 is a top view of the collector of FIG. 4; and

FIG. 6 is a side view of a folded collector ready for disposal.

DETAILED DESCRIPTION OF THE PREFERRED EMBODIMENT

The collector includes an outer seamless pouch 10 formed from a sheet of plastic film material by any of the known methods. The pouch is formed from a material that is water impermeable. The pouch has an open top 12. An adhesive patch 14 is disposed on the outside of the pouch near its opening 12. The patch 14 is normally covered by a release liner 16. As shown particularly in FIG. 2, the sides of the pouch 10 are provided with tear lines 18 which extend from the opening 12 toward but short of the bottom of the pouch 10. The tear lines 18 may be formed by any of the known methods of weakening plastic film such as micro perforations. As shown in FIG. 3, the formed pouch is relatively flat with the tear lines 18 disposed along the lateral edges of the pouch.

"As shown in FIGS. 3 and 5, a layer 20 of a highly absorbent material is disposed against the inside of the pouch in all areas except at or adjacent to the tear lines 18. The layer 20 is preferably made, of abatt. of cellulose or other material commonly used in-disposablediapers. The layer 20 may include additives that enhance the absorption and retention of liquids."

In its normal state, the open end of the pouch will accept the male genitalia for collection of urine which is absorbed in the layer 20. Once used, the release liner is removed, the pouch is folded, and the adhesive patch is pressed against an opposing outside surface of the pouch, as shown in FIG. 6. The pouch may also be held closed by use of other means, such as hook and loop fasteners.

To adapt the collector for use by a female, the tear lines are ruptured so that the pouch can be opened to a greater extent than normal, as shown in FIG. 4. The widely opened pouch can now be placed against the female genitalia for use to collect urine. Note that the absorbent layer is present on both sides after tearing and that a portion of the pouch remains to provide a pocket 22 for the retention of urine. After use, the pouch is folded and sealed wit the adhesive patch as before.

The collector can be adapted for use in collecting human feces from either males or females. This is accomplished by opening the pouch to the extent necessary by rupturing at the tear line. The pocket 22 remains to collect and hold the feces.

I claim:

1. A disposable bodily waste collector convertible from male to female use, comprising:

a one-piece flexible, water impervious pouch of plastic film having an opening at one end and a closed bottom at an opposite end, the pouch having tear lines along opposite sides that lead from the opening toward the bottom, the tear lines terminating at a point short of the bottom; and an absorbent layer disposed within the pouch against the inside of the pouch in all areas except at and adjacent to the tear lines, said layer extending towards the bottom of the pouch;

the collector being converted from male use to female use by separating the pouch along the tear lines into two portions joined adjacent the bottom and with each portion including the absorbent layer.

2. A collector according to claim 1, together with an adhesive patch on the outside of the pouch adjacent the opening.

3. A collector according to claim 2, together with a release liner normally covering the adhesive patch.

4. A collector according to claim 1, wherein the pouch is relatively flat and the tear lines are disposed along the lateral edges of the pouch.

* * * * *